US006078006A

United States Patent [19]

Räisänen et al.

[11] Patent Number: 6,078,006

[45] Date of Patent: Jun. 20, 2000

[54] STRINGED MUSICAL INSTRUMENT TRANSDUCER AND PROCEDURE FOR ITS FABRICATION

[75] Inventors: Heikki Räisänen, Espoo; Lasse Räisänen, Oulu, both of Finland

[73] Assignee: EMF Acoustics Oy Ltd., Espoo, Finland

[21] Appl. No.: 09/155,828

[22] PCT Filed: Nov. 8, 1996

[86] PCT No.: PCT/FI96/00605

§ 371 Date: Oct. 6, 1998

§ 102(e) Date: Oct. 6, 1998

[87] PCT Pub. No.: WO97/39602

PCT Pub. Date: Oct. 23, 1997

[30] Foreign Application Priority Data

Apr. 17, 1996 [FI] Finland ..... 961688

[51] Int. Cl.[7] ..... G10H 3/04

[52] U.S. Cl. ..... 84/733; 84/723; 84/DIG. 24

[58] Field of Search ..... 84/723–726, 728, 84/730–731, 733, DIG. 24

[56] References Cited

U.S. PATENT DOCUMENTS

| | | | |
|---|---|---|---|
| 4,382,328 | 5/1983 | Janszen | 29/594 |
| 4,654,546 | 3/1987 | Kirjavainen | 307/400 |
| 5,123,325 | 6/1992 | Turner | 84/731 |
| 5,204,487 | 4/1993 | Turner | 84/731 |
| 5,319,153 | 6/1994 | Fishman | 84/731 |
| 5,670,733 | 9/1997 | Fishman | 84/731 |

FOREIGN PATENT DOCUMENTS

| | | |
|---|---|---|
| 7-160265 | 3/1993 | Japan . |
| WO 96/06718 | 3/1996 | WIPO . |

*Primary Examiner*—Brian Sircus
*Assistant Examiner*—Marlon T. Fletcher
*Attorney, Agent, or Firm*—Helfgott & Karas, PC.

[57] ABSTRACT

Stringed musical instrument transducer for converting vibrations into electric signals. The transducer is composed of at least one transducer element (118) at least one dielectric film (107, 108), on at least one side of the transducer element, at least one signal electrode (109) and at least two ground electrodes (111–113), the transducer element having a transducer part (116) and a connection element part (115). The transducer element is an electret film containing a permanent electric charge. The film is a cell type electret film. The transducer part has a laminated structure. At least the signal electrode is a film like layer, disposed on the surface of the dielectric film. The transducer have the unitary laminated structure, where the signal and the ground electrodes are disposed on the surface of at least one dielectric film and continue unitary from the transducer part as a connection element part, the electrodes extend from the transducer part of connection element part for connecting the transducer to a signal processing device.

17 Claims, 14 Drawing Sheets

STRINGED MUSICAL INSTRUMENT TRANSDUCER AND PROCEDURE FOR ITS FABRICATION

The present invention relates to a stringed musical instrument transducer for converting string vibrations into electric signals, and to a procedure for its fabrication. The transducer is especially applicable for use with a guitar.

PRIOR ART

Saddle transducers for acoustic guitars, designed to convert string vibrations into electric signals, are mounted under the saddle of the guitar. They have a transducer part of a length corresponding to that of the saddle and typically containing different layers of electromechanical material, dielectric material and electrically conductive electrode layers, and a connection cable part in which the signals are taken to a preamplifier inside the guitar via a small hole (diameter typically 3 mm) bored in the guitar's resonance box under the saddle. Saddle transducers may typically have a single-layer or a multi-layer structure.

As electromechanical material, piezoelectric crystals or piezoelectric sheet (e.g. polyvinylidene fluoride PVDF) are currently used. In the commonest transducer structures, the connecting cable part is implemented using screened coaxial cable, which is connected to the electrode layers of the transducer part by soldering. Such a transducer is presented e.g. in U.S. Pat. No. 5,319,153. A drawback with this type of structures is the difficulty of fabrication of the transducer and relatively high manufacturing costs, because much of the work has to be done manually. Moreover, the connections to the preamplifier generally have to be made by soldering, because no connectors of sufficiently small size to go through the hole provided under the saddle are available for coaxial cables and because the connection between the transducer itself and the cable makes it impossible to mount the transducer from below. In addition, piezoelectric crystals and sheets are associatd with a certain characteristic sound that is not quite in keeping with the guitar's own acoustic sound.

The so-called electret field, or the permanent electric charge injected into dielectric material (may also contain semiconducting material) by ionizing, is based on interlocking of ions with molecules and crystal structure.

A dielectric film and manufacturing process for same, applicable for use as electromechanical material for a stringed musical instrument transducer, is described in U.S. Pat. No. 4,654,546, said dielectric film comprising a biaxially oriented foamed homogenous film layer containing flat lenslike or "shredded" or cavitated gas bubbles. The term "dielectric electret bubble film" is used here to refer to electromechanical film manufactured as described in that patent and having an permanent electric charge injected into material.

WO-publication 96/06718 presents a procedure for pressure inflation of a prefoamed plastic film, that makes it possible to manufacture strongly foamed film products, involving a high foaming degree and allowing the thickness of the product to be increased without increasing the amount of plastic material. The term "swelled dielectric electret bubble film" is used herein to refer to a foamed film-like plastic product manufactured as described in that WO-publication and having a permanent electric charge injected into material.

SUMMARY OF THE INVENTION

The object of the present invention is to eliminate the drawbacks of prior art and achieve an improved transducer of a completely new type for a stringed musical instrument, in which a swelled dielectric electret bubble film is used to convert the vibration of strings into electric signals. Flat lenslike gas bubbles in the electret film effectively limit the mobility of electret charges in the dielectric material, because the gases have an electric resistance five decades better than the best solid insulating materials have. At the same time, they act as an elastic layer during the conversion of string vibrations into electric signals.

A further object of the invention is to produce a new type of stringed musical instrument transducer which, due to its elastic structure containing gas bubbles, is capable of converting string vibrations into electric signals which, when converted into sound, better correspond to the instrument's own acoustic sound and allows playing at high volumes before feedback.

Another object of the invention is to produce a stringed musical instrument transducer which is of a construction thin enough to permit installation without changing any parts of the instrument, e.g. making the saddle lower, and which, when installed, therefore does not affect the instrument's own acoustic sound and is as easy to install as possible without soldering.

Another object of the invention is to produce a stringed musical instrument transducer capable of converting the vibration of each string separately into an electric signal.

A further object of the invention is to produce a stringed musical instrument transducer as simple as possible, having no separate transducer part and no separate conductor for connecting it to a signal processing device, but which has a unitary, flexible and laminated structure and in which the connections for connecting it to a preamplifier can be disposed in sequence or side by side and which in itself is able to produce a balanced signal (differential transducer) according to the attached claims.

This kind of transducers can be very economically fabricated by printing the required electrodes by the serigraphic method with silver paste on sheets of dielectric film (e.g. polyester), placing several electrodes side by side on the same sheet. By laminating such sheets and dielectric electret bubble film being preferably swelled on top of each other so that dielectric electret bubble film is only placed on a desired area at one end of the sheet while the other end is provided with a connector part with different electrode layers side by side, a laminate sheet is obtained from which the transducers can be cut out e.g. by punching. After that, it is only necessary to join a suitable connector to the electrodes at the connector end of the transducer by pressing mechanically.

With this procedure, it is possible to produce transducers of desired length, design and width, in which the electrodes in the transducer part are continuous up to the preamplifier and which are unitary, flexible and thin in construction. Fabrication is faster and more economic than with conventional methods.

The structure of the invention thus allows the application of an effective and economic production technique, especially when the transducer is of the same width over its entire length. In this case, the transducers can be printed closely side by side, producing no material waste. The structure of the invention makes it possible to produce a transducer of the same width and therefore very economic for the commonest acoustic guitars, which have a saddle width of 2.4–3.2 mm. This width is still sufficient for the connector of a single electrode. The structure of the invention allows a maximum amount of transducers to be produced from the same materials by the same amount of work.

The costs of the punching tool used for cutting out the transducers may be reduced as only one cutter blade is needed for each transducer to be cut out. In addition, such a transducer is very easy to install because it can also be mounted from the outside.

BRIEF DESCRIPTION OF THE DRAWINGS

In the following, the invention is described in more detail by the aid of examples by referring to the attached drawings, in which.

DETAILED DESCRIPTION

Figure 1:
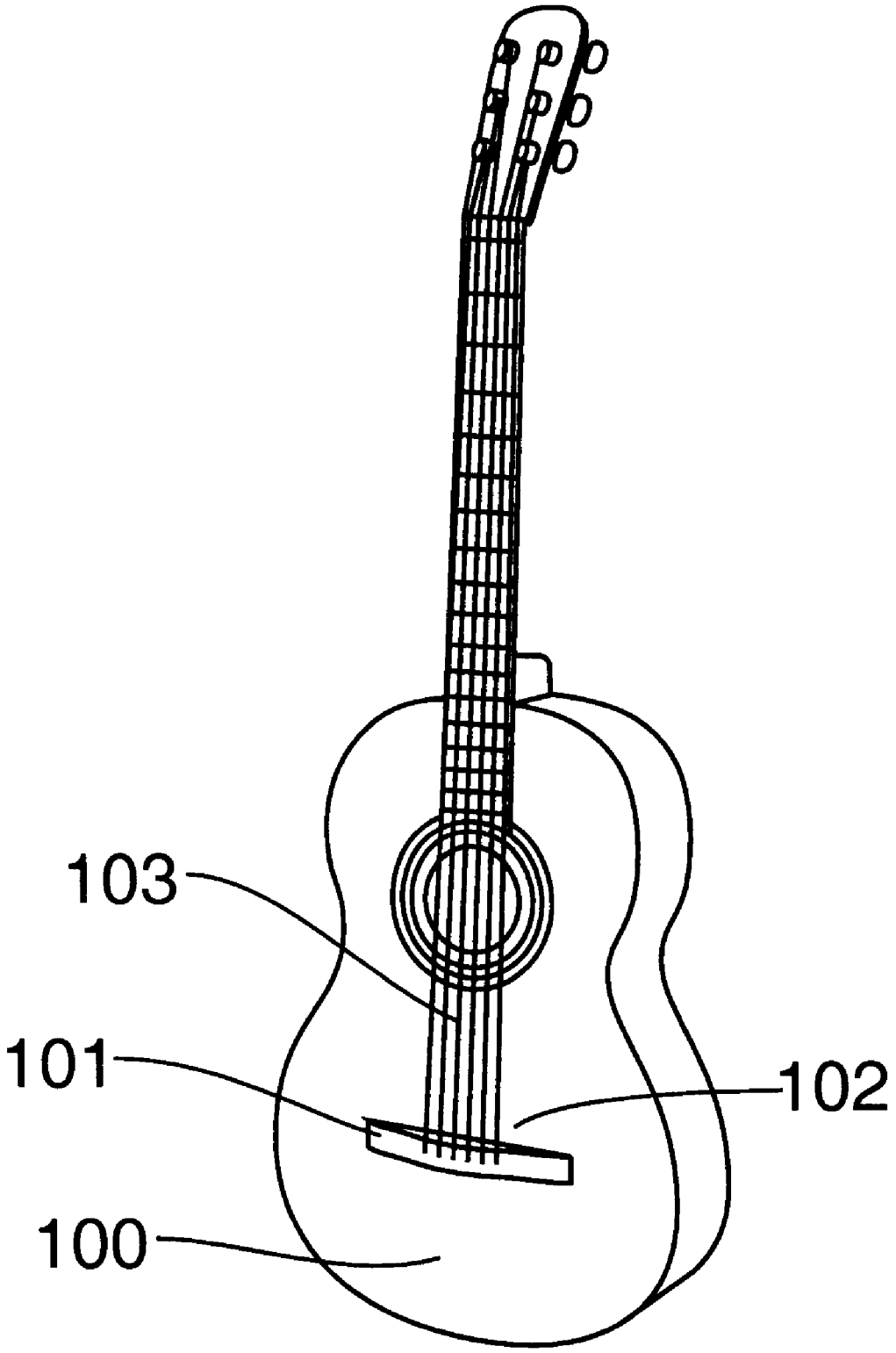
FIG. 1 is a perspective view of a guitar, with a transducer as provided by the invention mounted on it.
Figure 2A:
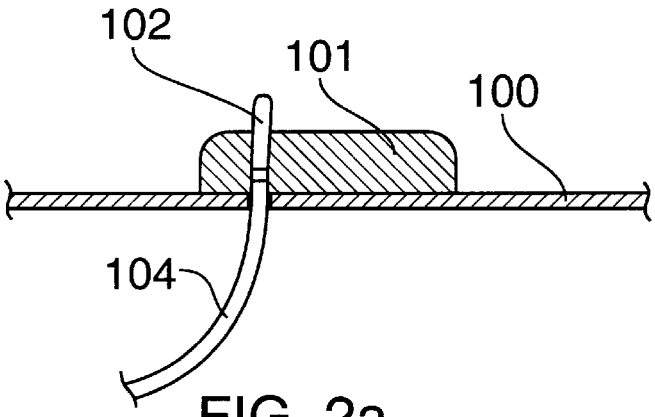
FIGS. 2*a*–2*c* present a cross-sectional view, top view and a longitudinal section of the saddle of a guitar with a transducer as provided by the invention mounted in conjunction with it.
Figure 2B:
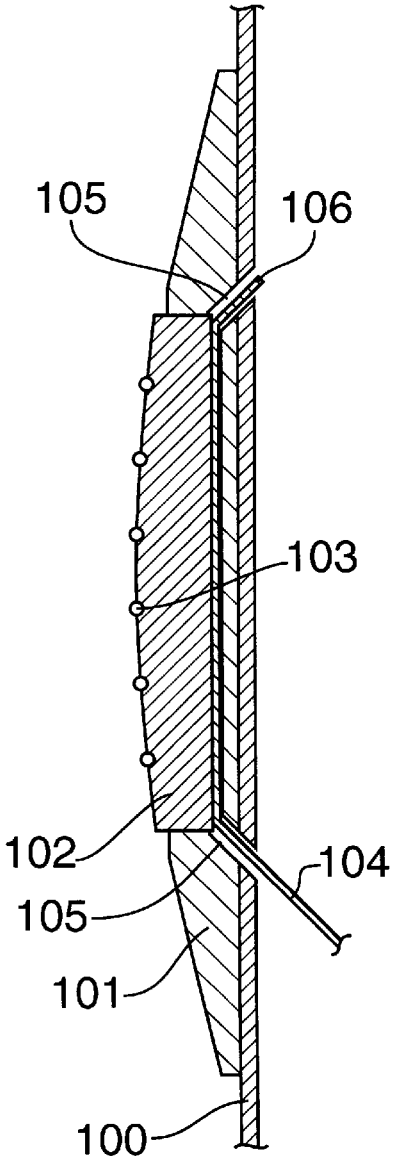
Figure 2C:
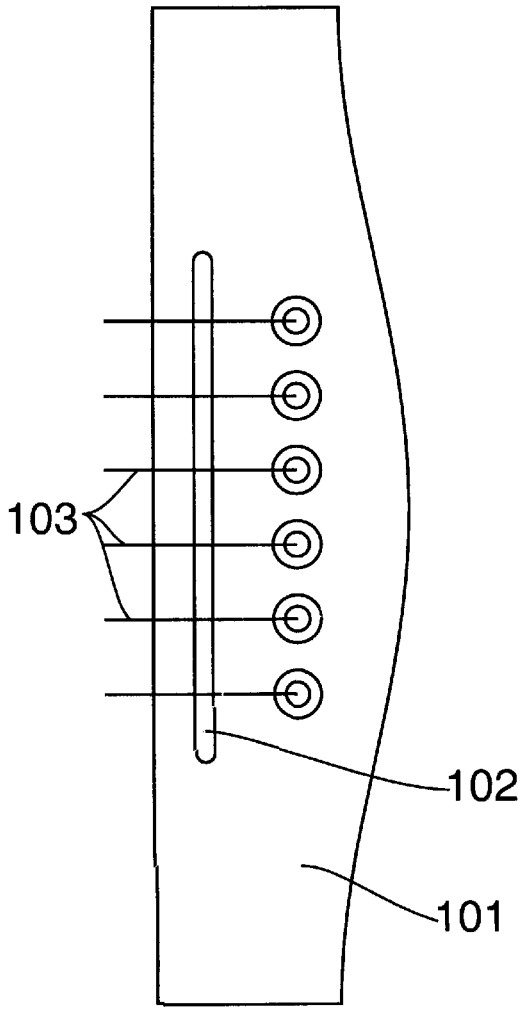

In FIGS. 1, 2*a*, 2*b*, 2*c*, the cover 100 of the resonance box of an acoustic guitar is presented. Fitted on the resonance box is a transverse bridge for the six strings 103 of the guitar, consisting of a bridge body 101 placed against the resonance box 100 and a saddle 102, whose upper edge is provided with notches for the strings 103.

Fitted under the saddle 102 is a transducer 104 as provided by the invention for converting the vibrations of the strings 103 into electric signals.

Figure 3A:
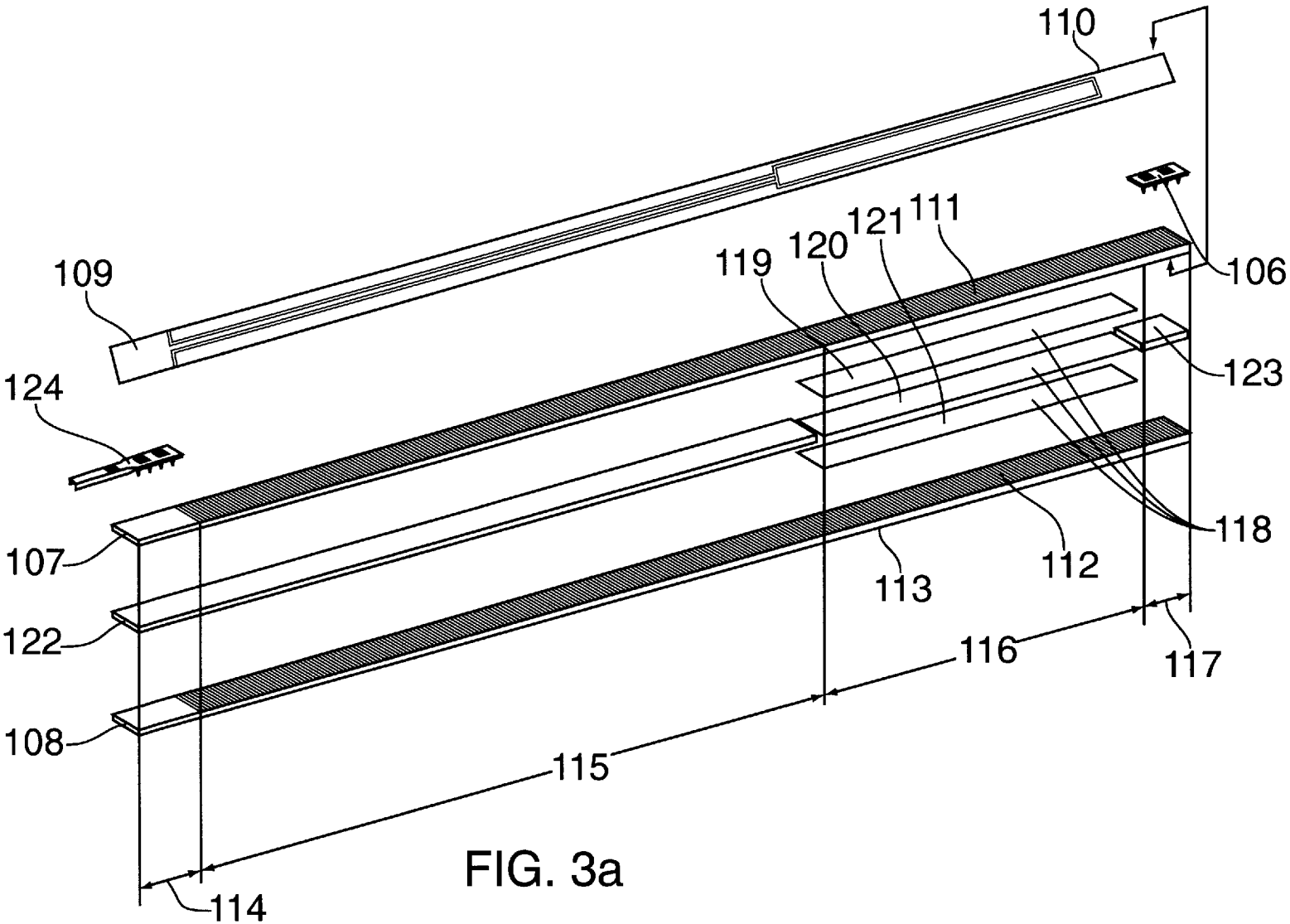
FIGS. 3*a*–3*d* present exploded perspective views illustrating the different components that comprise the transducer of the four different embodiments of the invention.

In the embodiment of FIG. 3*a* the transducer of the invention is composed of sheets 107 and 108 of dielectric film, which may be made e.g. of 0.1 mm thick polyester. On the underside of sheet 107, a signal electrode 109 is printed by the serigraphic technique using e.g. silver or graphite. Printed around the signal electrode 109 is a ground electrode 110, which reduces electromagnetic interference noise in the signal. It is noted, however, that this ground electrode 110 is not essential to the structure. Printed by the serigraphic technique on the top surface of film sheet 107 is a ground electrode 111, which may also consist of aluminium foil or other electrically conductive foil suited for the purpose. Seriprinted on the top surface of sheet 108 is a ground electrode 112 and on the bottom surface also a ground electrode 113. It should be noted that this ground electrode 113 is not essential for the structure in this and other embodiments of the invention, where the transducer is not a differential transducer. Sheet 108 may also consist of e.g. thin aluminium or brass foil or other electrically conductive foil suited for the purpose. It is noted that the ground electrodes 110, 111, 112, 113 are shorter at the end 114 pointing towards the preamplifier than the signal electrode 109, whereas at the other end 117 the ground electrodes are somewhat longer than the signal electrode. Instead of being serigraphically printed, the electrodes may also be evaporated e.g. from aluminium onto dielectric films using a mask. Between the sheets 107, 108 there is an element 118. This element 118 is composed of three preferably swelled dielectric electret bubble films 119, 120, 121. Injected onto the underside of the topmost film 119 is a negative electric charge. Injected onto the top side of the intermediate film 120 is also a negative electric charge, while a positive electric charge is injected onto its underside. Injected onto the top side of the bottommost film 121 is a positive electric charge. After being charged, the films have been glued together. The bottommost films 121 bottom side may also be provided with a metallic electrically conductive surface, e.g. evaporated aluminium, which is to be noted is not necessary. This electrically conductive surface is possible to have also on topside as well as on one or both sides of films 119 (on topside when ground electrode 110 is not printed) and 120 but it is not recommended. With the charging procedure described, a maximal electric charge density is achieved. From the point of view of operation, it is sufficient to have only the surfaces of the intermediate film 120 charged. Such an element responds only to the pressure generated by the vibration of the strings, not to bending at all. The element may also consist of two dielectric electret bubble films, in which element 118 unlike charges of the films 119, 121 are placed opposite to each other. Such a structure mainly responds to pressure only and very slightly to bending and is thus applicable for converting the vibrations of the strings 103 into electric signals. By placing the films with like charges opposite to each other, an element mainly responsive to bending is achieved. For operation, it is sufficient that element 118 be composed of only one swelled dielectric electret bubble film. Between sheets 107 and 108 there is also a dielectric film 122, which may be made e.g. of polyester, preferably of the same thickness as the film element 118. This insulation prevents a short circuit between the signal electrode 109 and the ground electrode 112. Instead of using a dielectric film 122, it is possible to provide the bottom surface of film 107 at the area 115 or the top surface of film 108 at the area 115 with dielectric insulation serigraphically printed over the electrode(s) on the surface to prevent short circuit. Between the film sheets 107, 108 there is also a dielectric film 123 on the other side of the element 118 at the area 117, preferably of the same thickness as film 122. Another possibility is to extend the element 118 consisting of dielectric electret bubble films to the end of area 117, in which case film 123 is not needed. Similarly, it is possible to extend the element 118 to the end of area 114 as well, in which case film 122 is not needed. At one end 117 of the transducer is a metallic connector 106 mechanically pressed through sheets 107, 123, 108, shorting the ground electrodes 111, 110, 112, 113. At the other end 114 is a metallic connector 124 mechanically pressed through sheets 107, 122, 108 to connect the signal electrode 109 to a signal processing device. The ground electrodes, which are all thus disposed on the outer surfaces of film sheets 107, 108, are grounded e.g. by pressing them between the halves of the casing of the signal processing device. It is recommendable to use a soft, electrically conductive material in this area between the halves of the casing. The grounding can also be implemented by pressing one of the ground electrodes 111, 113 against the circuit board of the signal processing device at a point reserved for it, at which point it is also recommendable to use electrically conductive rubber as mentioned above. Reference is now made to the FIGS. 4*a*–4*b*. Disposing the signal electrode and the ground electrodes in this way in sequence at the end of the transducer and grounding the transducer in the ways described above eliminates tension and also provides a transducer structure narrow enough to allow the transducers electrodes seriprinted closely side by side on the dielectric film sheets 125, 126, e.g. polyester of thickness 0,1 mm, maximizes the amount of the transducers from material and labour used. In addition (referring to FIGS. 2*a*, 2*b*, 2*c*), such a narrow transducer having the same width throughout its length is very easy to install, because the connector of an individual electrode is so narrow that, in all guitars commonly used, in which the saddle width is on the order of 3 mm, it can go from above through the two holes 105 made on the sides of the bridge body 101 under the saddle 102 through the resonance box cover 100 to the inside of the guitar to connect the transducer to a signal processing device.

Figure 3B:
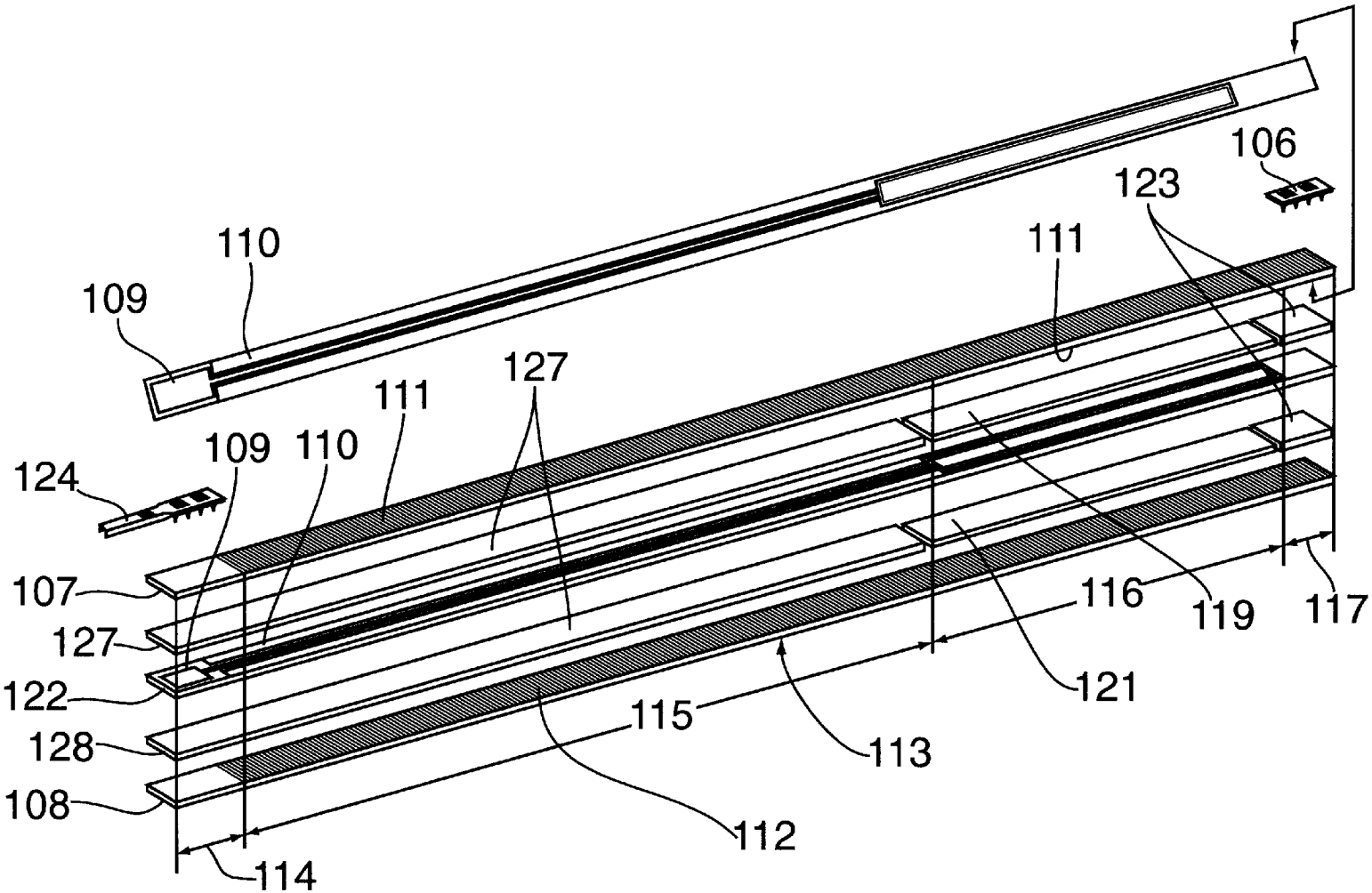
Figure 3C:
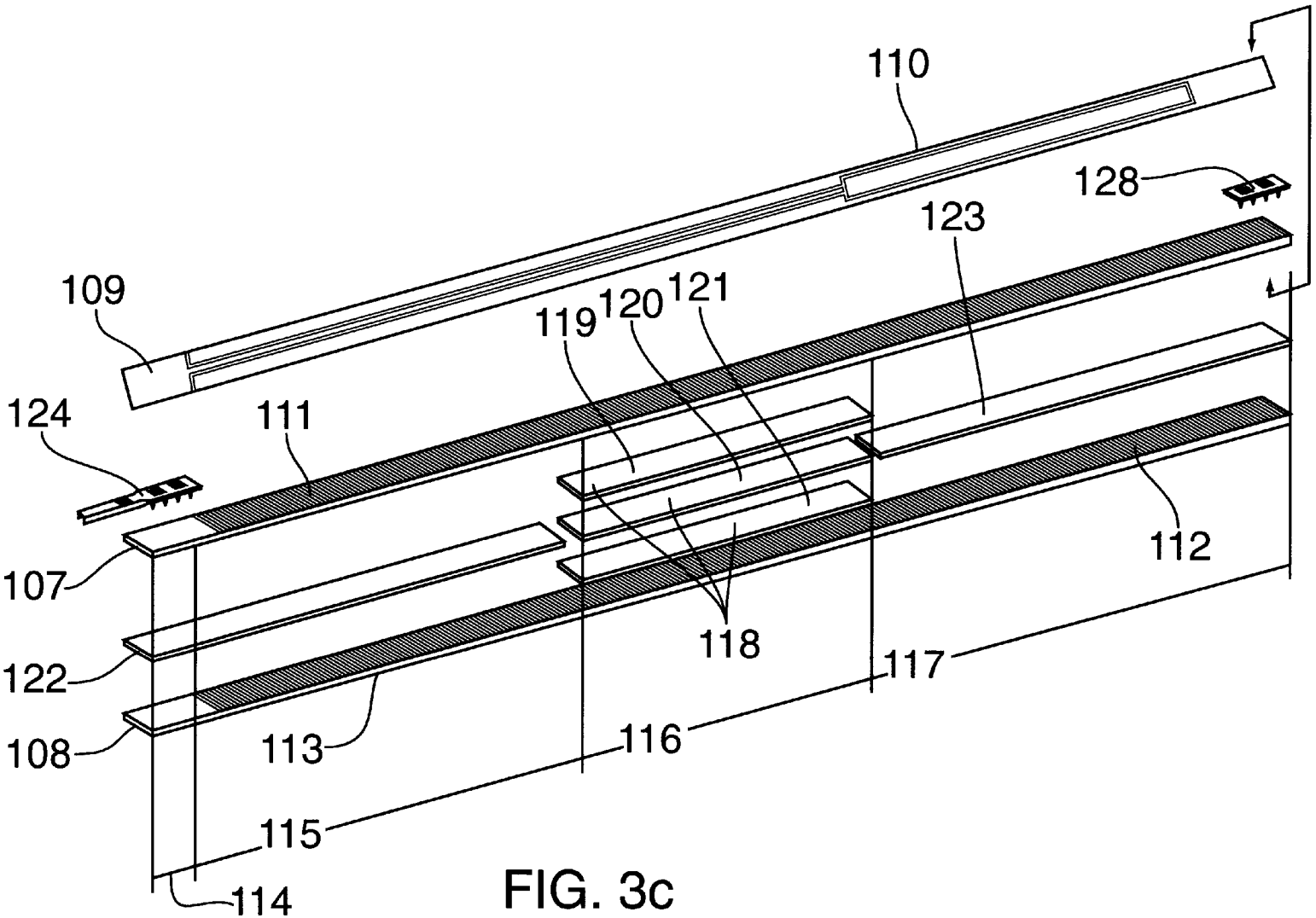
Figures 3D, 3E:
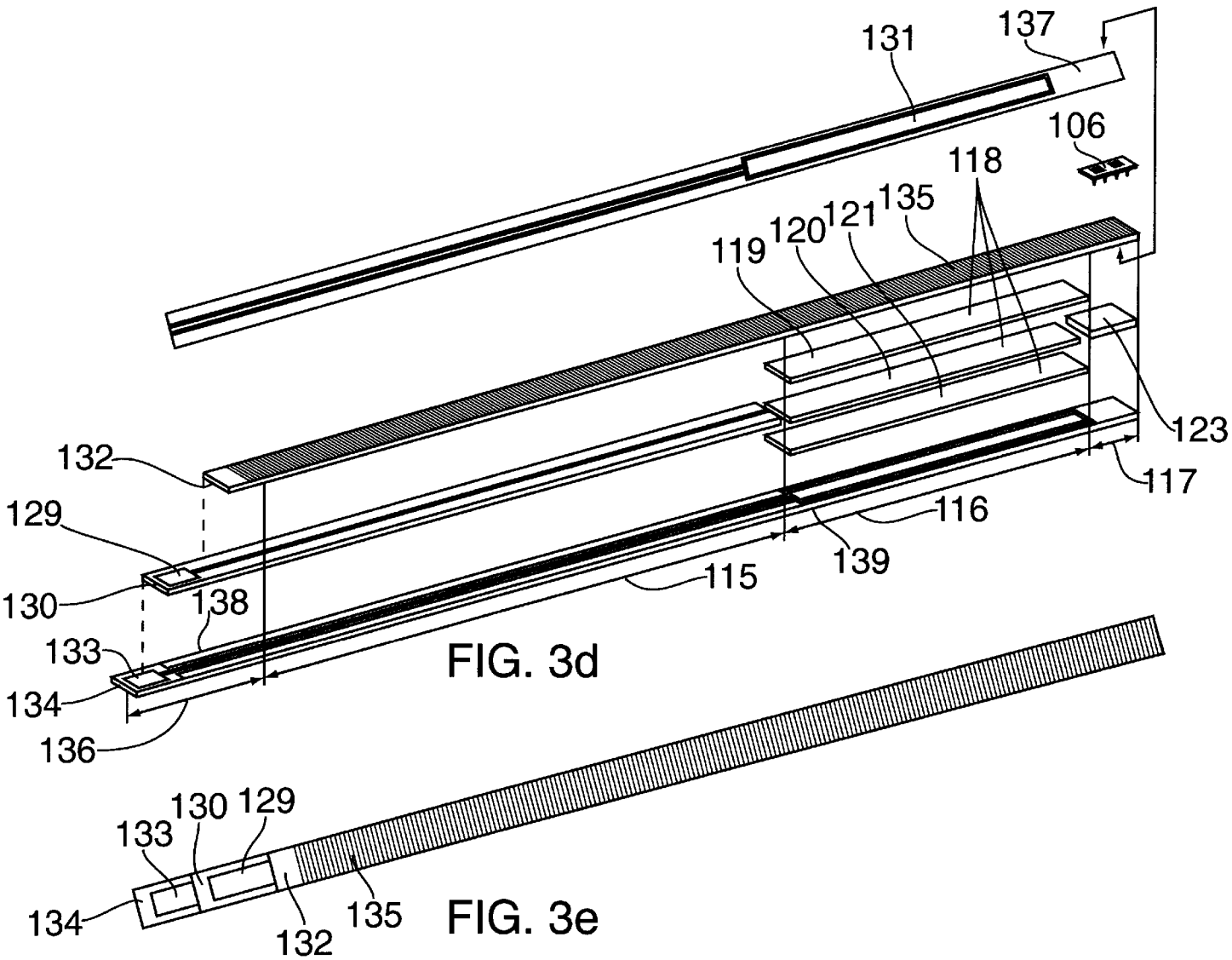
FIG. 3*e* presents top view of the embodiment of the invention presented in FIG. 3*d*.
Figure 5A:
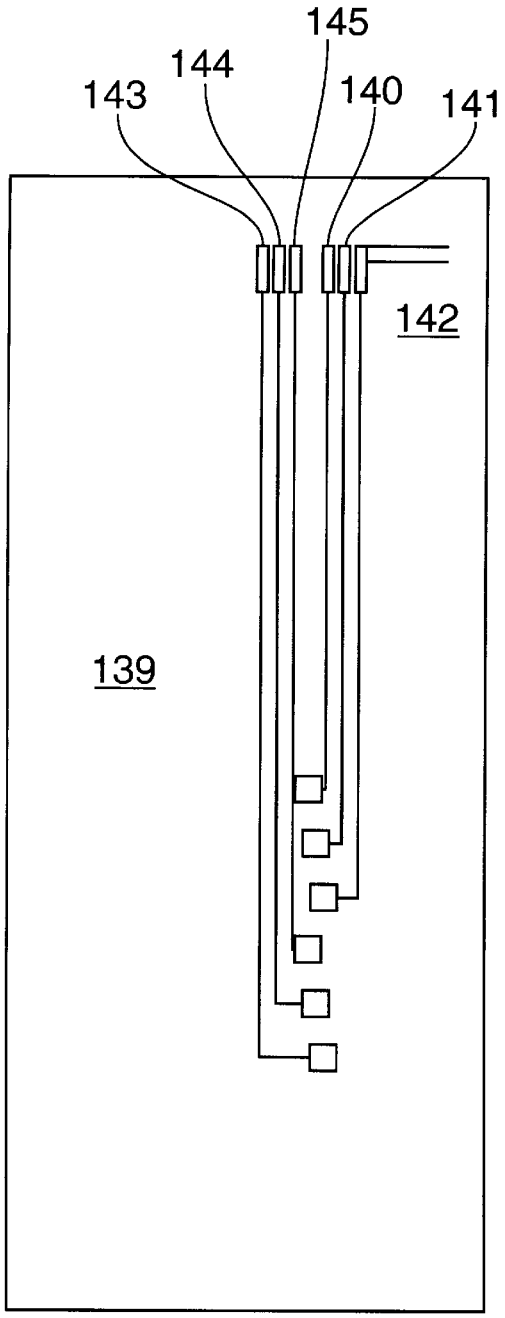
FIGS. 5*a*–5*d* present signal electrodes and ground electrodes printed on a sheet of dielectric film of two different embodiments of the invention, the two transducers having different electrodes at the connector end side by side.
Figure 5B:
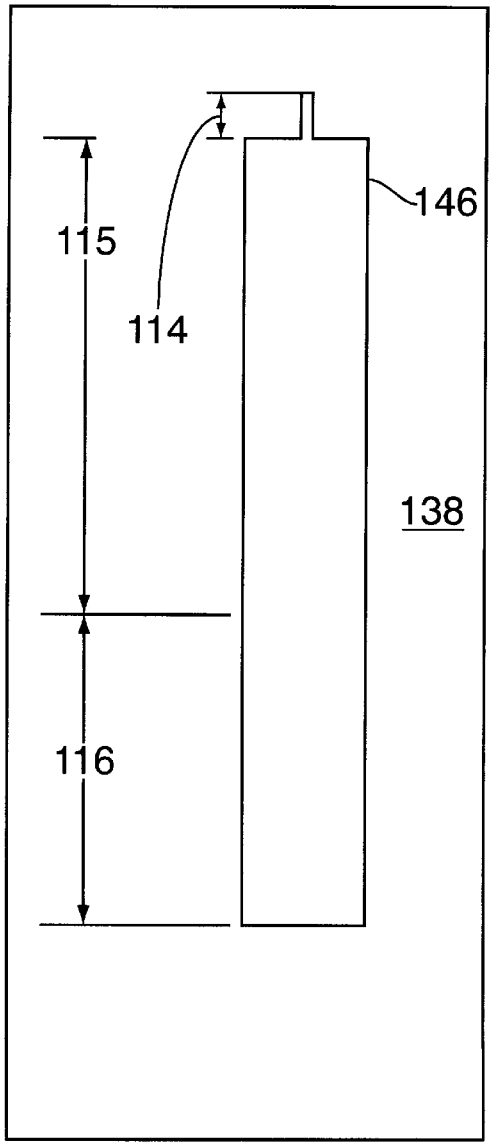
Figure 5C:
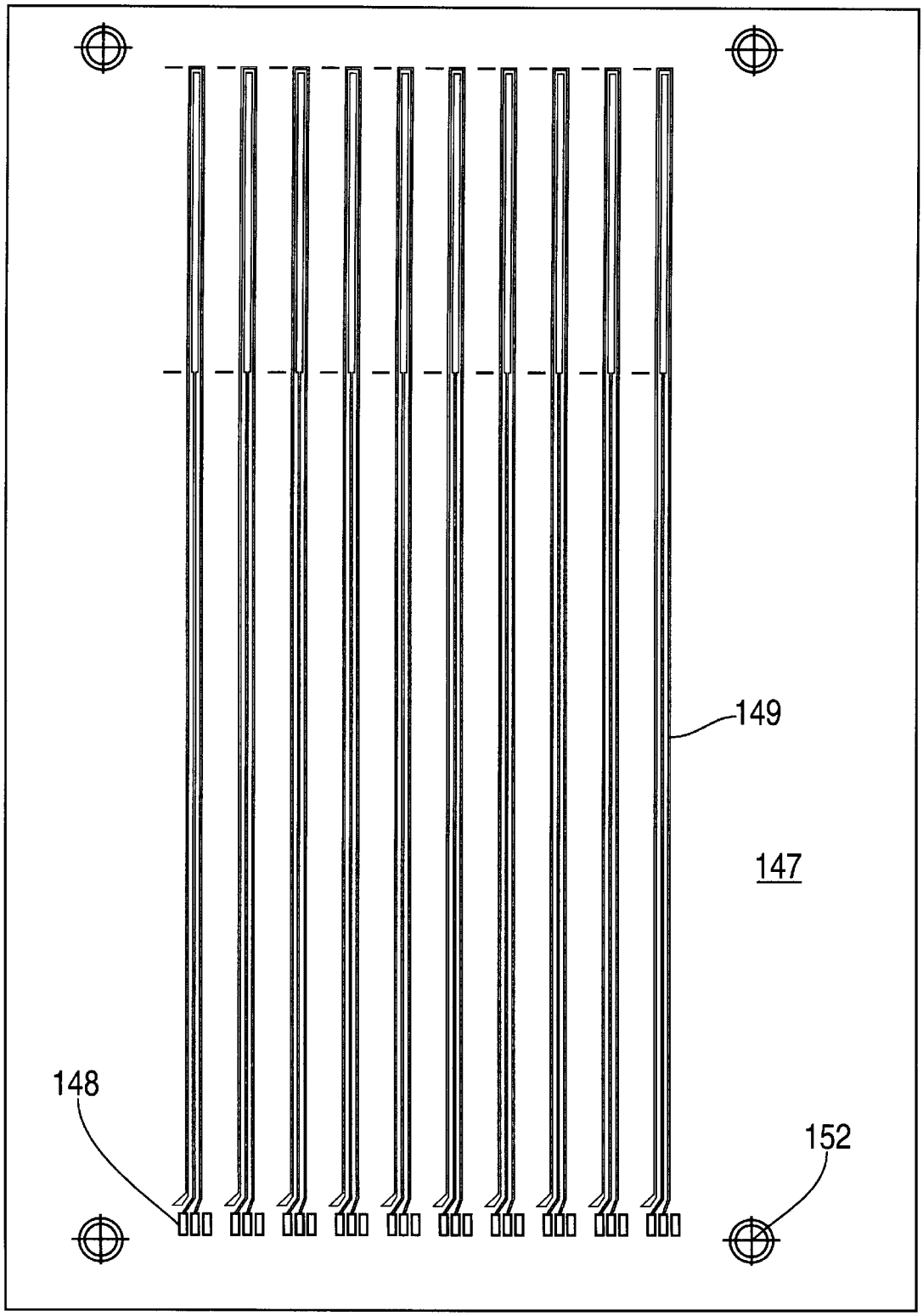
Figure 5D:
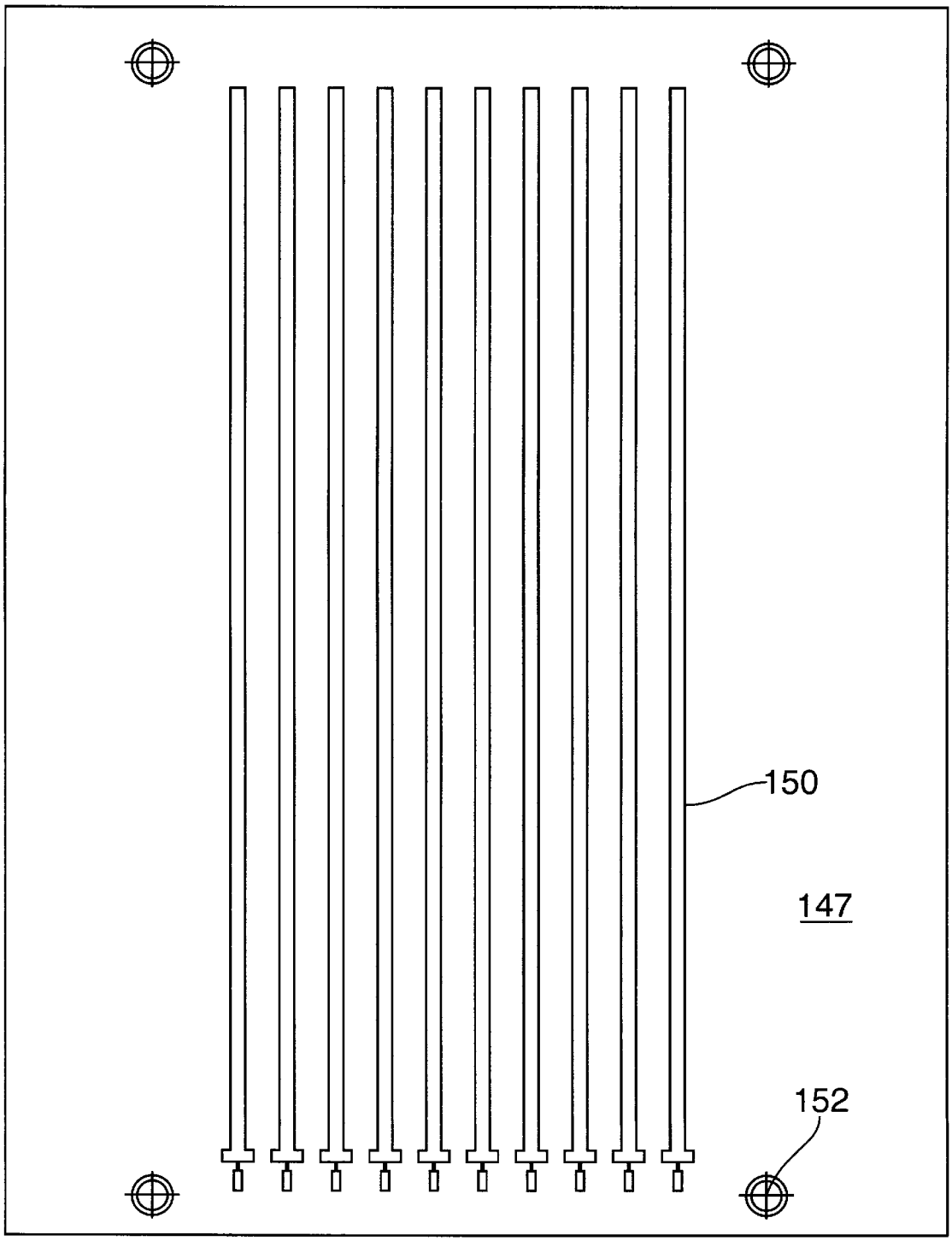
Figure 7:
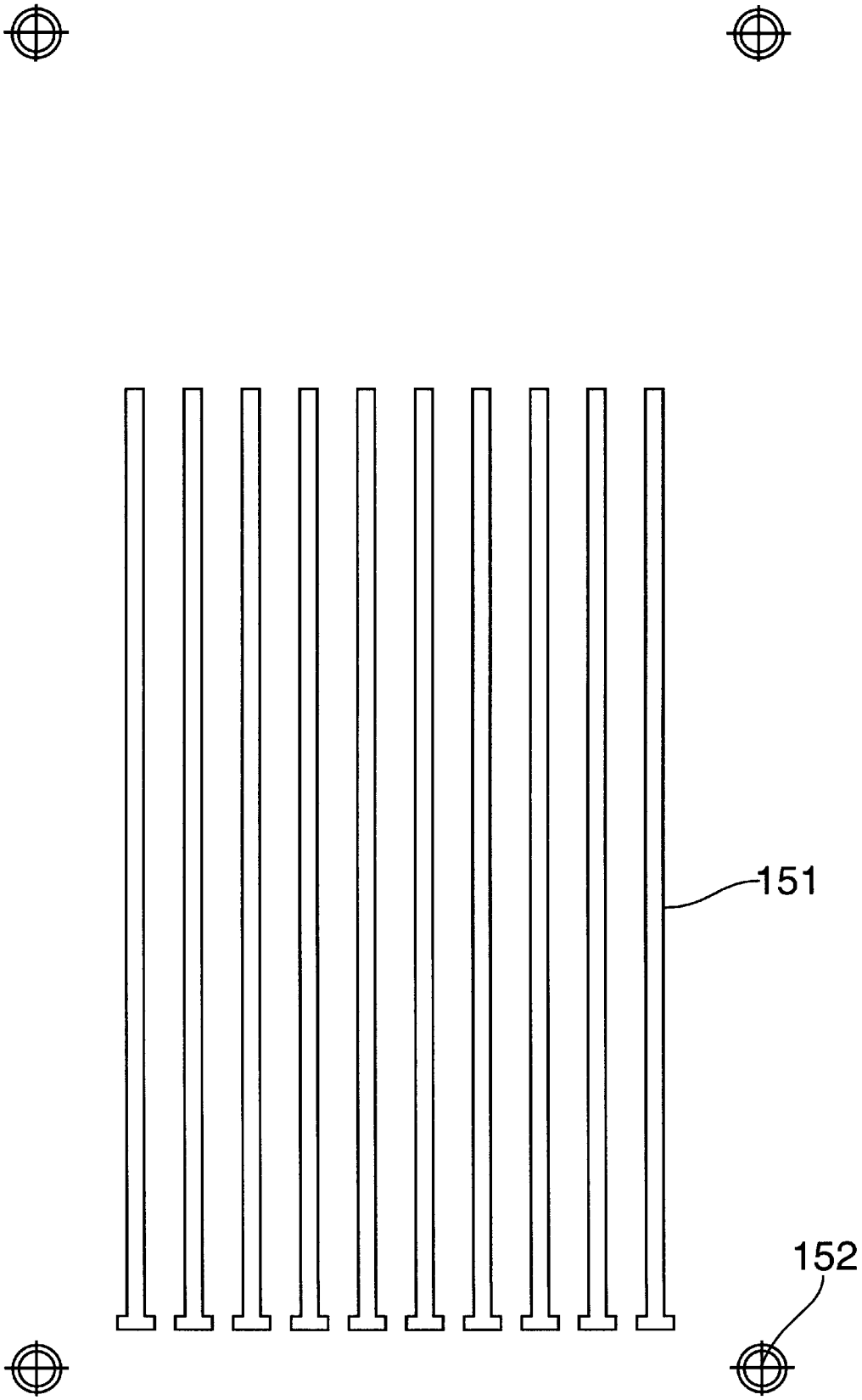
FIG. 7 presents pattern for seriprinting the insulation over the signal and ground electrodes, of the transducer of the embodiment in FIG. 5*c*.

In the embodiment of FIG. 3*b* a transducer of the invention is fabricated in such manner that film 122 is continuous extending through areas 114, 115, 116, 117. Seriprinted on both the top side and on the bottom side of the film 122 is a signal electrode 109 and around it ground electrode 110, which ground electrode is again not essential to the structure. Seriprinted on both the top and bottom side of sheet 107 is an ground electrode 111. Seriprinted on top side of sheet 108 is ground electrode 112 and on the underside another ground electrode 113. Ground electrodes 111, 112, 113, do not extend to area 114. All ground electrodes are connected together by means of a connector 106. Disposed in area 116 above and below sheet 122 are preferably swelled dielectric electret bubble films 119, 121. Positive charges are injected onto the underside of sheet 119 and onto the top side of sheet 121. Negative charges may be injected onto the top side of sheet 119 and onto the underside of sheet 121 but it is not essential. By pressing a connector 124 on area 114, the signal electrodes 109 are connected together. At the area 115 between the sheets 107–122 and 122–108 is a dielectric film 127 to prevent short circuit between signal and ground electrodes. In this embodiment of the invention the dielectric electret bubble films are connected in parallel. Reference is now made to FIG. 3*c*. By making the length of area 115 so long that connector 128 reaches the signal processing device too, a transducer is obtained whose ground electrodes 111, 110, 112, 113 can be connected to the circuit board of a signal processing device by means of a connector 128. Further, by using an arrangement where no ground electrode 110 is printed and on the top side of the sheet 108 to the areas 116, 117 is printed a signal electrode and by grounding both ground electrodes 111, 113 to the case of the signal processing device in the manner explained above, none of said ground electrodes 111, 113 extending to the connectors 124, 128, a differential transducer is obtained. In the embodiment of FIG. 3*e* a differential transducer of the invention is implemented by seriprinting signal electrode 129 on the top side of sheet 130 and connecting this signal electrode 129 to the signal electrode 131 using electrically conductive glue between sheets 130 and 132. This signal electrode 129 is made somewhat shorter than the sheet 130 itself. The signal electrode 133 seriprinted on the top side of sheet 134, which is electrically connected to the underside of the bottommost sheet 121 of the element 118, extends to the end of the sheet 134. The ground electrode 135 printed on the top side of sheet 132 is somewhat shorter than the sheet 132. At the transducer end 136, the film sheet lengths are such that sheet 132 is the shortest one of the sheets. Sheet 130 is somewhat longer and sheet 134 is the longest one. At the other end 117 of the transducer is a connector 106 which connects ground electrodes 135, 137, 138, 139 together. It is to be noted again that ground electrodes 138, 139 are not essential to the structure. In this way, an arrangement is achieved in which all signal and ground electrodes of the differential transducer needed to connect to a signal processing device are located sequentially at one end 136 of the transducer and on the same side of it (ref. FIG. 3*e*), enabling it to be connected to the circuit board of a signal processing device by pressing it onto the circuit board at a position provided with corresponding electrodes in sequence. If desired, grounding can also be effected via a connection between the halves of the casing as described above. By replacing the signal electrode 133 with an electrode which is printed in the shape of an ground electrode and has a length such that it is shorter at the transducer end 136 than sheet 130 and extends correspondingly to the other end 117 of the transducer, a non-differential transducer is obtained in which the electrodes for connecting the transducer to a signal processing device are on the same side in sequence at one end of the transducer. Reference is now made to FIGS. 5*a*–5*d*. If desired, the signal and ground electrodes can also be printed so that they are placed side by side at the transducer end 114 as illustrated by FIGS. 5*a*–5*c*. In FIG. 5*a* there is signal electrodes seriprinted on a dielectric sheet 139 of an embodiment of the invention in which there is a separate signal electrode 140, 141, 142, 143, 144, 145 for each string of the guitar, in this case an electric guitar. The vibration of each string of the instrument is transversed in to electric signal by the means of having a separate saddle like piece under each string against disposed signal electrode of the transducer, the chargesignal generated to each electrode being processed separately in the signal processing device. This type of hex-microphone is needed e.g. for making a stereo image or in midi equipment, where the electronics converts the tone pitch into a voltage value controlling a synthesizer. In this embodiment too, the dielectric electret bubble film is placed on the area 116, an insulation is provided in the area 115 and metallic connectors 124 are mechanically pressed through the electrodes in the transducers end 114. In FIG. 5*b* there is the ground electrode 146 printed on a dielectric sheet 138, e.g. polyester of the embodiment described above. In FIGS. 5*c*, 5*d* the pattern for printing the signal and ground electrodes of another embodiment of the invention where the transducer, in this case a differential transducer is obtained having the electrodes side by side at the connector end 114. In that embodiment the pattern shown in FIG. 5*c* shows signal electrodes 148 and around them ground electrodes 149. This pattern is printed say on top side of the dielectric sheet 147 and on bottom side is printed the ground electrodes, as illustrated in FIG. 5*d*. The pattern for seriprinting the dielectric insulation 151 over the electrodes shown in FIG. 5*c* is showed in FIG. 7.

Figure 4A:
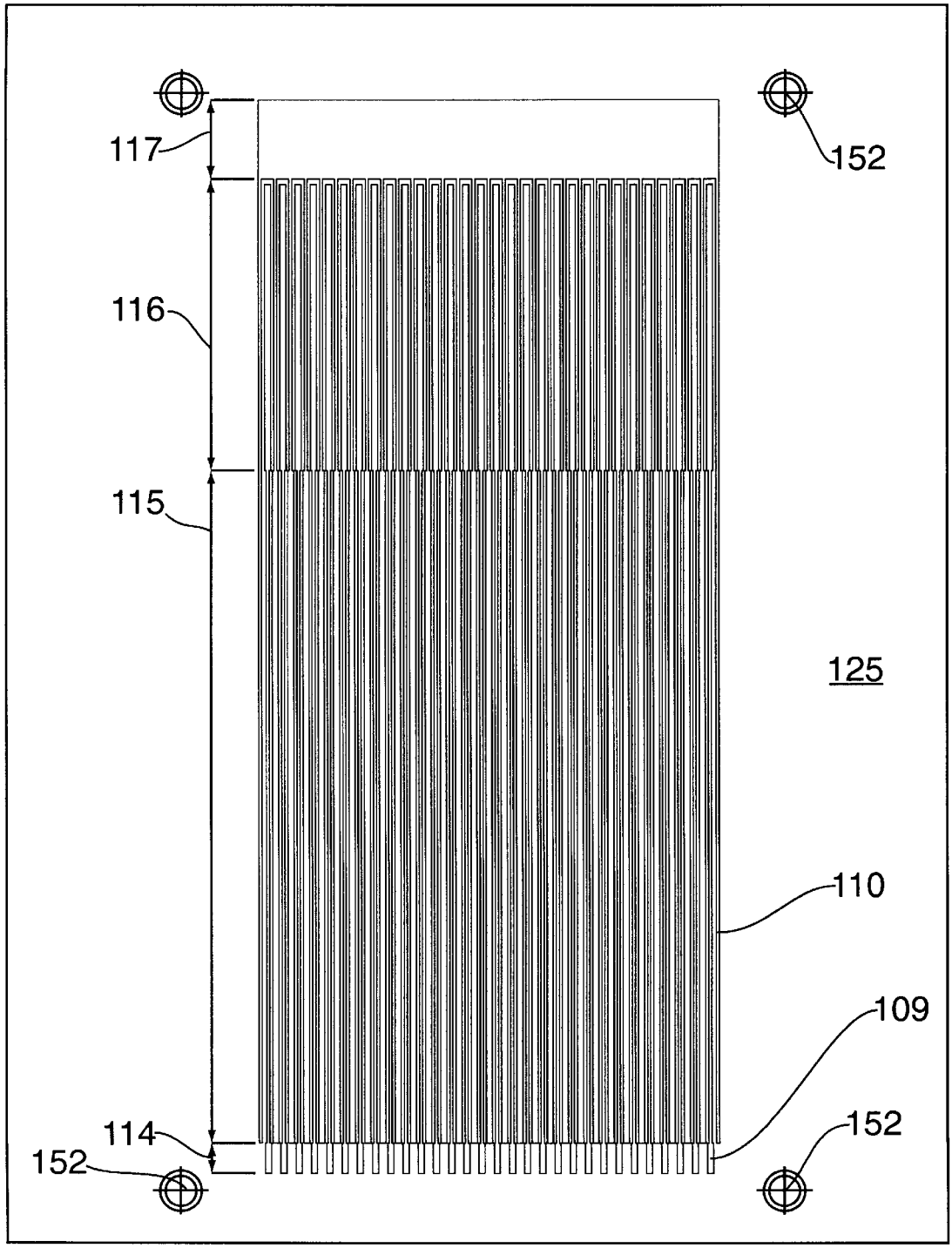
FIGS. 4*a*, 4*b* present the signal and earth electrodes, printed on a sheet of dielectric film, of the transducer of the embodiment in FIGS. 3*a* and 3*b*.
Figure 4B:
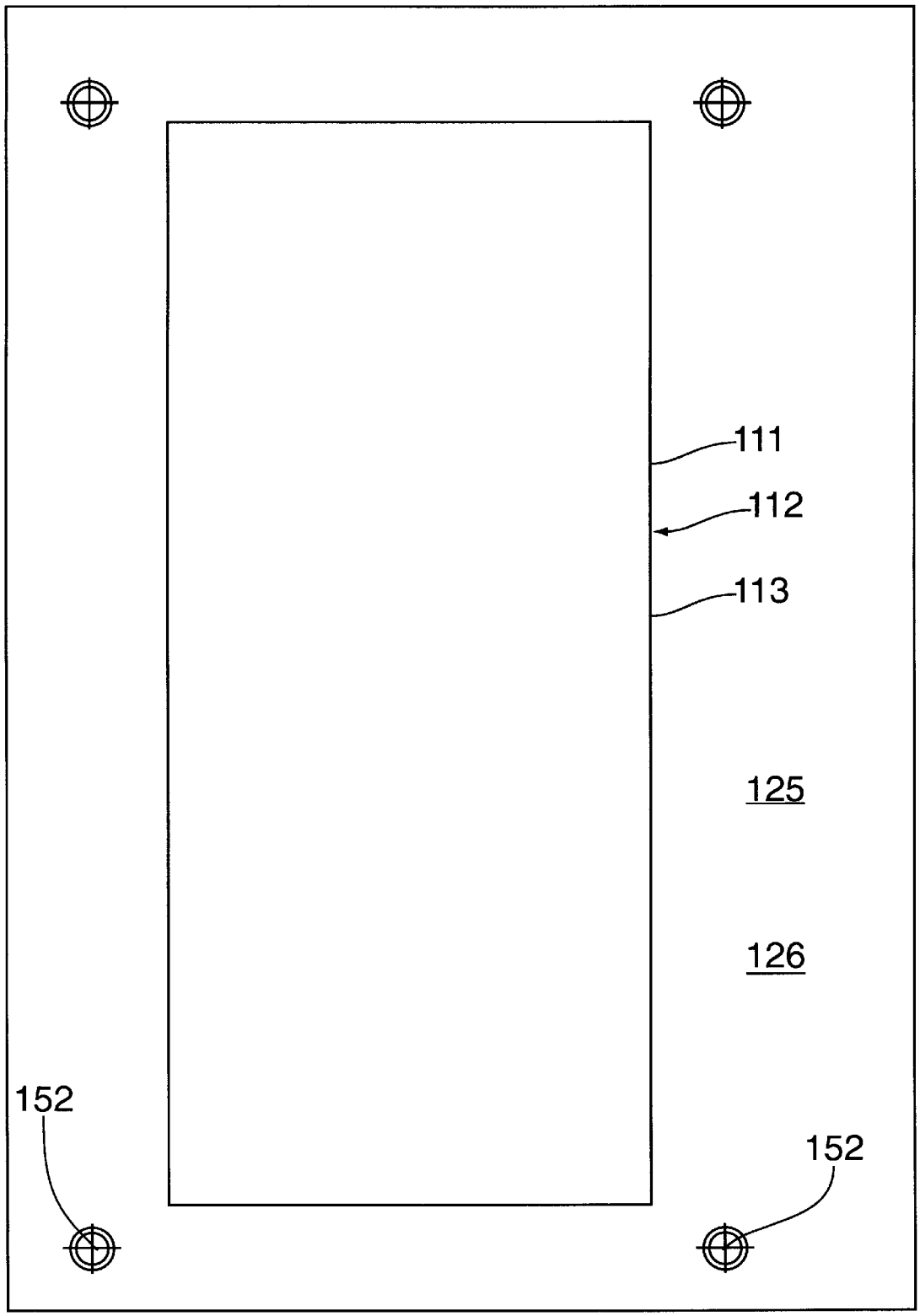
Figure 6A:
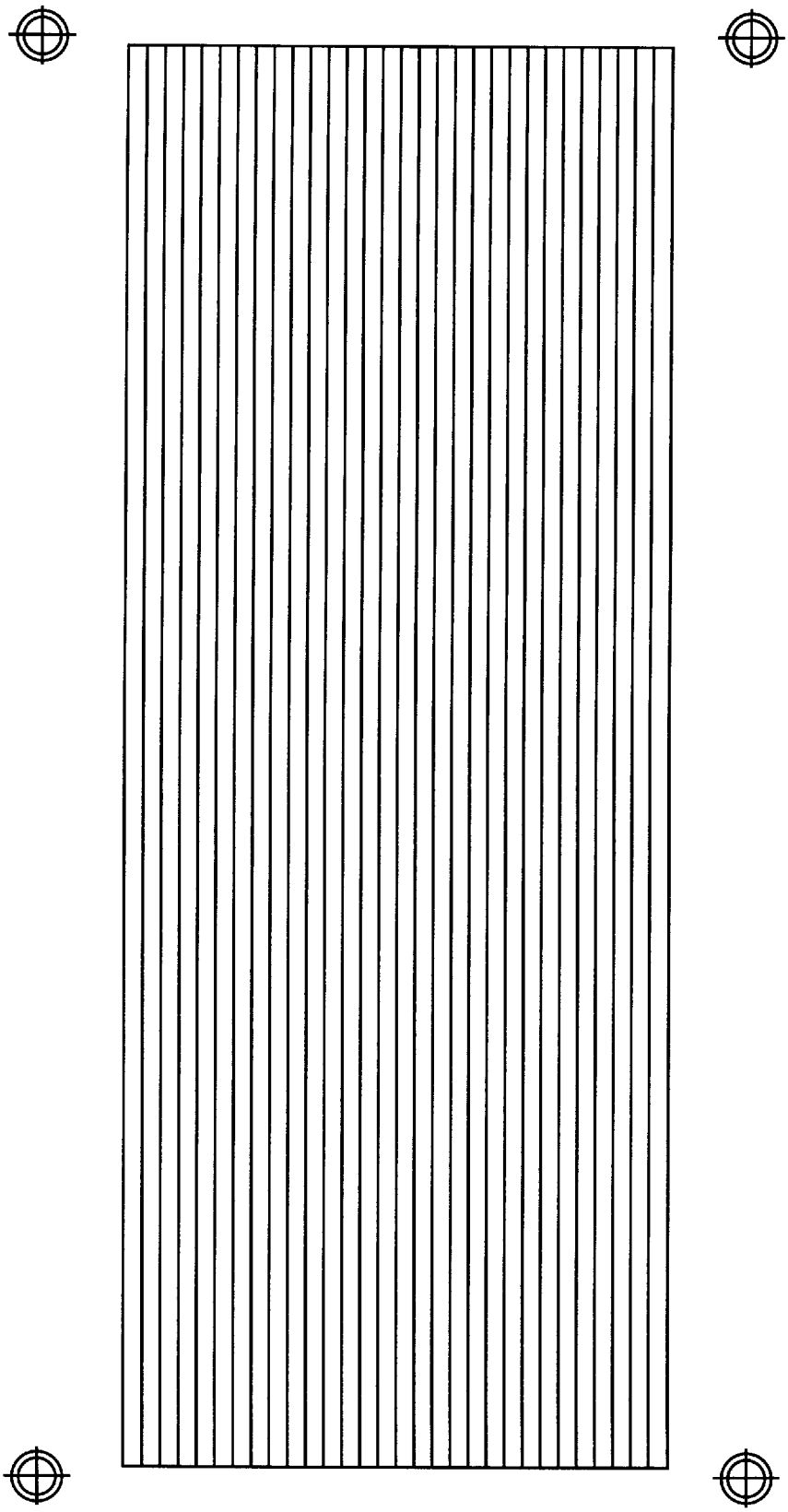
FIGS. 6*a*–6*b* present top view of the cutter blades of a punching unit of the transducer of the embodiment illustrated in FIGS. 3*a*, 3*b*, 5*c*, 5*d*.
Figure 6B:
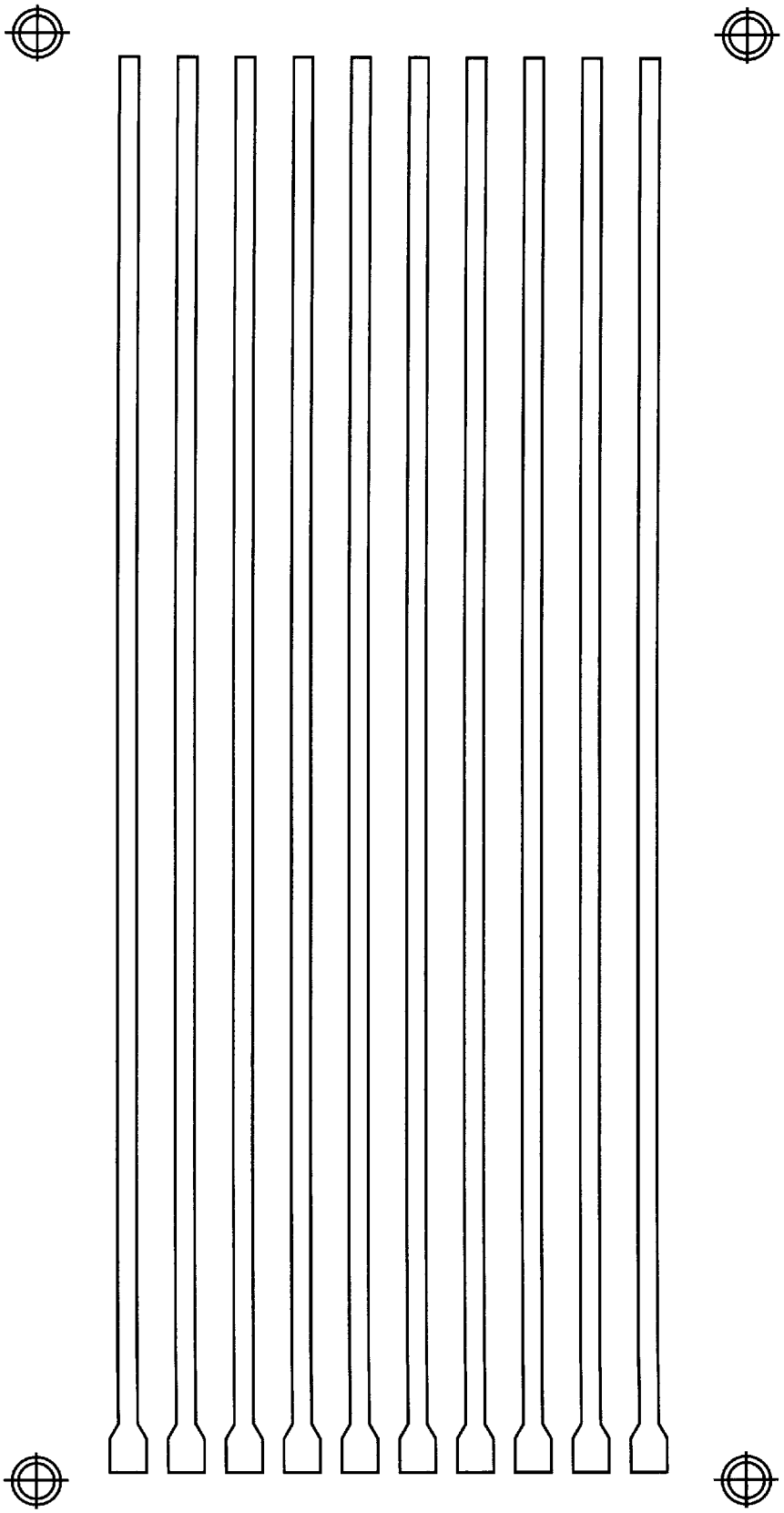

Referring now to FIGS. 3*a*, 3*c*, 4*a*, 4*b*, the transducers of the two embodiments of the invention as shown FIGS. 3*a*, 3*c* are fabricated by first applying suitable glue on the dielectric film 125 on the side where the signal and ground electrodes are seriprinted with silver or graphite paste as shown in FIG. 4*a*. To the other side of this film 125, there is ground electrodes seriprinted as shown in FIG. 4*b*. After this, dielectric sheet cutted to suitable size is glued in to the area 117. An element 118 size large enough, consisting a laminate of 1–3 dielectric electret bubble film, preferably swelled, is glued on area 116 and sheet 122 on areas 114, 115. Then glue is applied in the sheet 126 as shown FIG. 4*b*, where there is same ground electrode pattern seriprinted on the both sides of this sheet. The side with glue applied is then glued opposite to the above mentioned laminate, with the register marks 152 in corners in alignment. In this way, a laminate is obtained, from which the transducers can be punched off with a tool as shown in FIG. 6*a*. The transducers can also be cut out from the sheet using e.g. a laser or water jet or some other technique suited for the purpose. This procedure allows a considerably larger number of thin, flexible stringed musical instrument transducers of desired length and width and having a continuous structure without joints than by conventional methods to be fabricated by the same amount of work while the manufacturing costs remain low.

It is obvious to the person skilled in the art that different embodiments of the invention are not restricted to the examples described above, but that they can be varied within the scope of the claims presented below. The number of films and layers on top of each other can be chosen in accordance with the need in each case and the transducer can also have a shape other than rectangular in top view.

We claim:

1. Stringed musical instrument transducer for converting vibrations into electric signals, said transducer is composed of at least one transducer element (118), at least one dielectric film (107, 108) on at least one side of the transducer element, at least one signal electrode (109) and at least two ground electrodes (111–113), the transducer element having a transducer part (116) and a connection element part (115), wherein the transducer element is a electret film, containing a permanent electric charge, the film being a cell-type electret film, the transducer part has a laminated structure, where at least the signal electrode is a film-like layer disposed on the surface of the dielectric film, and wherein the transducer has a unitary laminated structure, where the signal and ground electrodes are disposed on the surface of the at least one dielectric film and continue unitary from the transducer part as a connection element part, the electrodes extend from the transducer part as connection element part for connecting the transducer to a signal processing device.

2. Transducer as defined in claim 1, wherein the electrodes at the connector end for connecting the transducer to a signal processing device are disposed side by side.

3. Transducer as defined in claim 1, wherein the at least one signal electrode for connecting the transducer to a signal processing device is disposed at one end of the transducer, with a connector mechanically pressed onto said electrode.

4. Transducer as defined in claim 1, wherein the ground electrodes are electrically connected together at the other end of said transducer with a mechanically pressable connector and thus disposed on at least one outer surface of the transducer to connect them to a signal processing device.

5. Transducer as defined in claim 1, wherein several of the signal electrodes are disposed on the surfaces of one or more thin and flexible dielectric materials in such manner that in each one of the signal electrodes a separate charge signal is generated when the string above the electrode vibrates, and said electrodes together with the ground electrodes of the transducer constitute all the electrically conductive surfaces required in the transducer to connect the transducer to a signal processing device and which transducer is constructed of a unitary and flexible layered sheet structure.

6. Transducer as defined in claim 1, wherein all the signal and ground electrodes of the transducer are disposed side by side at the connector end to connect them to a signal processing device.

7. Transducer as defined in claim 1, wherein the transducer element (118) is disposed between the dielectric films and the signal electrode (109) is disposed on a side of the dielectric film (107) which faces the transducer element (118).

8. Transducer as defined in claim 1, wherein the signal electrode is essentially inside the transducer structure in order to reduce the interference noise.

9. Stringed musical instrument transducer for converting vibrations into electric signals, said transducer is composed of at least one transducer element (118), at least one dielectric film (107, 108) on at least one side of the transducer element, at least one signal electrode (109) and at least two ground electrodes (111–113), the transducer element having a transducer part (116) and a connection element part (115), wherein the transducer element is a electret film, containing a permanent electric charge, the film being a cell-type electret film, the transducer part has a laminated structure, where at least the signal electrode is a film-like layer being disposed on the surface of the at least one dielectric film, and wherein the transducer element is a dielectric electret bubble film, said dielectric film is a biaxially oriented foamed homogenous film layer comprising essentially flat gas bubbles.

10. Transducer as defined in claim 9, wherein the transducer element is a swelled dielectric electret bubble film.

11. Stringed musical instrument transducer for converting vibrations into electric signals, said transducer is composed of at least one transducer element (118), at least one dielectric film (107, 108) on at least one side of the transducer element, at least one signal electrode (109) and at least two ground electrodes (111–113), the transducer element having a transducer part (116) and a connection element part (115), wherein the transducer element is a electret film, containing a permanent electric charge, the film being a cell-type electret film, the transducer part has a laminated structure, where at least the signal electrode is a film-like layer being disposed on the surface of the at least one dielectric film, and wherein the signal electrode is essentially inside the transducer structure in order to reduce the interference noise.

12. Procedure for fabricating stringed musical instrument transducer comprising the steps of:

forming a stringed musical instrument transducer for converting vibrations into electric signals, said transducer is composed of at least one transducer element (118), at least one dielectric film (107, 108) on at least two ground electrodes (111–113), the transducer element having a transducer part (116) and a connection element part (115), the transducer element is a cell-type electret film, containing a permanent electric charge, the transducer part having a laminated structure, where at least the signal electrode is a film-like layer being disposed on the surface of the dielectric film, and forming said electrodes (129, 135) of one or more electromechnical films; and disposing said electrodes by arranging them side by side on said dielectric film and gluing said at least one dielectric film and the transducer element film against each other so that electromechanical film is placed in a desired area, said electrode film surfaces forming one or more electrically conductive surfaces required by each transducer.

13. Procedure for fabricating a stringed musical instrument transducer according to claim 12, wherein the electrically conductive surfaces formed by the electrodes are so disposed that they lie in sequence at at least one end of the transducer to connect them to a signal processing device.

14. Procedure for fabricating a stringed musical instrument transducer according to claim 12, wherein the first suitable fastening substance is applied on the dielectric film (125) on the side where the signal electrode is, an element (118) size large enough, consisting of a laminate of at least one electret film, is fastened on transducer area (116), and that fastening substance is applied in the sheet (126) to form ground electrodes, and that the side with fastening substance applied is then fastened opposite to the above mentioned laminate, with the register marks (152) in alignment.

15. Procedure for fabricating a stringed musical instrument transducer according to claim 12 or 14, wherein a laminate is obtained, from which the transducers are cut out.

16. Procedure as defined in claim 12, wherein the electromechanical film is a dielectric electret bubble film, biaxially oriented foamed homogenous film layer comprising essentially flat gas bubbles, wherein a permanent electric charge has been injected into the film material.

17. Procedure as defined in claim 16, wherein the electromechanical film is a swelled dielectric electret bubble film.

* * * * *